US007559489B2

(12) United States Patent
Noestheden

(10) Patent No.: US 7,559,489 B2
(45) Date of Patent: Jul. 14, 2009

(54) HIGH-PRESSURE PULSE NOZZLE ASSEMBLY

(75) Inventor: Andrew Noestheden, Tecumseh (CA)

(73) Assignee: Valiant Corporation, Windsor (CA)

( * ) Notice: Subject to any disclaimer, the term of this patent is extended or adjusted under 35 U.S.C. 154(b) by 506 days.

(21) Appl. No.: 11/466,619

(22) Filed: Aug. 23, 2006

(65) Prior Publication Data

US 2008/0048048 A1 Feb. 28, 2008

(51) Int. Cl.
*B05B 1/08* (2006.01)

(52) U.S. Cl. ..... 239/101; 239/99; 239/417.5; 239/419; 239/426; 239/435; 239/533.1; 239/525; 239/581.1; 239/589; 239/589.1; 239/590; 901/43

(58) Field of Classification Search ..... 239/99, 239/101, 407, 417.5, 419, 426, 433, 435, 239/499, 533.1, 533.15, 525, 553, 553.5, 239/569, 581.1, 589, 589.1, 590, 590.5, 416.5; 299/16, 17; 83/53, 177; 175/67, 424; 901/43
See application file for complete search history.

(56) References Cited

U.S. PATENT DOCUMENTS 3,521,820 A * 7/1970 Cooley ..... 239/101
3,593,524 A * 7/1971 Chermensky et al. ..... 239/101
3,841,559 A * 10/1974 Hall et al. ..... 239/101
4,474,251 A * 10/1984 Johnson, Jr. ..... 239/589.1
4,863,101 A * 9/1989 Pater et al. ..... 239/99
6,220,529 B1 * 4/2001 Xu ..... 239/101

* cited by examiner

*Primary Examiner*—Steven J Ganey
(74) *Attorney, Agent, or Firm*—Gifford, Krass, Sprinkle, Anderson & Citkowski, P.C.

(57) ABSTRACT

A high-pressure liquid projection assembly for cleaning and/or deburring industrial parts, having a housing with an inlet adapted for connection with a pressurized liquid source, an outlet and a fluid passageway connecting the inlet to the outlet. A fluid chamber is formed in the housing and disposed around an intermediate portion of the passageway. At least one opening is formed in the housing which fluidly connects the chamber to the passageway while a control port on the housing is fluidly connected to the chamber. The control port is adapted to be connected to a variable flow pressurized liquid source to thereby vary the projection cone pattern from the outlet as a function of the valve opening.

10 Claims, 2 Drawing Sheets

HIGH-PRESSURE PULSE NOZZLE ASSEMBLY

BACKGROUND OF THE INVENTION

I. Field of the Invention

The present invention relates generally to a high-pressure liquid projection assembly for cleaning and/or deburring industrial parts and, more particularly, to such an assembly with a variable spray pattern.

II. Description of Related Art

High-pressure liquid projection nozzles are used in many different industrial applications. For example, such nozzles are used for cleaning industrial parts, deburring industrial parts and the like. Such nozzles typically project the liquid at pressures of several thousand psi.

One disadvantage of these previously known nozzles, however, is that the nozzles are of a fixed geometry. As such, one nozzle may be utilized for deburring a part while different nozzles are used for spray washing other parts. Where the nozzles are manipulated by a robotic arm, the switching of nozzles to accomplish different manufacturing and/or cleaning operations undesirably adds cycle time to the overall industrial operation. Furthermore, when the nozzles are switched from one type of nozzle for one application to a different nozzle, it is necessary to employ cumbersome fluid couplings to ensure fluid-tight connections with the nozzle.

A still further disadvantage of these fixed geometry nozzles, particularly in washing applications, is that the steady state liquid projection used during the cleaning operation not only consumes excessive cleaning solution, but overflood the part to be treated and thus present a much lower efficiency. This not only increases the cost of the cleaning operation, but can also create environmental difficulties and expense in the disposal of the cleaning solution after use.

SUMMARY OF THE PRESENT INVENTION

The present invention provides a high-pressure liquid projection assembly which overcomes all of the above-mentioned disadvantages of the previously known devices.

In brief, the high-pressure liquid projection assembly of the present invention comprises a nozzle housing having an inlet adapted for connection with a pressurized liquid source, an outlet and a fluid passageway connecting the inlet to the outlet. A venturi is preferably formed at a midpoint of the fluid passageway.

A fluid chamber is formed in the housing so that the chamber is disposed around an intermediate portion of the passageway. At least one, and more typically several, circumferentially spaced openings are formed in the housing which fluidly connect the chamber to the passageway.

A control port is attached to the housing while a passage in the housing fluidly connects the control port to the chamber. The control port, furthermore, is adapted to be connected to a variable flow pressurized liquid source which variably introduces fluid from the chamber into the fluid flow through the passageway via the openings. In doing so, the liquid projection pattern from the outlet of the housing varies as a function of the liquid flow rate from the chamber through the openings and into the passageway.

In a preferred embodiment of the invention, a variable opening valve is fluidly connected between the inlet to the nozzle housing and the control port. Consequently, by variably opening the valve, variable flow is provided into the chamber and into the main liquid flow crossing the outlet cavity, to vary the projected cone pattern. The valve, furthermore, may be opened to different fixed positions in order to obtain different fixed projection cone patterns or, alternatively, may be cyclically opened and closed to produce a corresponding cycle of the variable projected cone pattern from the nozzle outlet.

The high-pressure liquid projection assembly of the present invention is advantageously used with a robotic arm wherein the robotic arm manipulates not only the position of the housing, but also controls the projected cone pattern by variably opening the valve. By thus obtaining different cone patterns as a function of the valve opening, a single liquid spray assembly of the present invention may be used to perform numerous and different manufacturing and/or cleaning operations.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figures 1, 2:
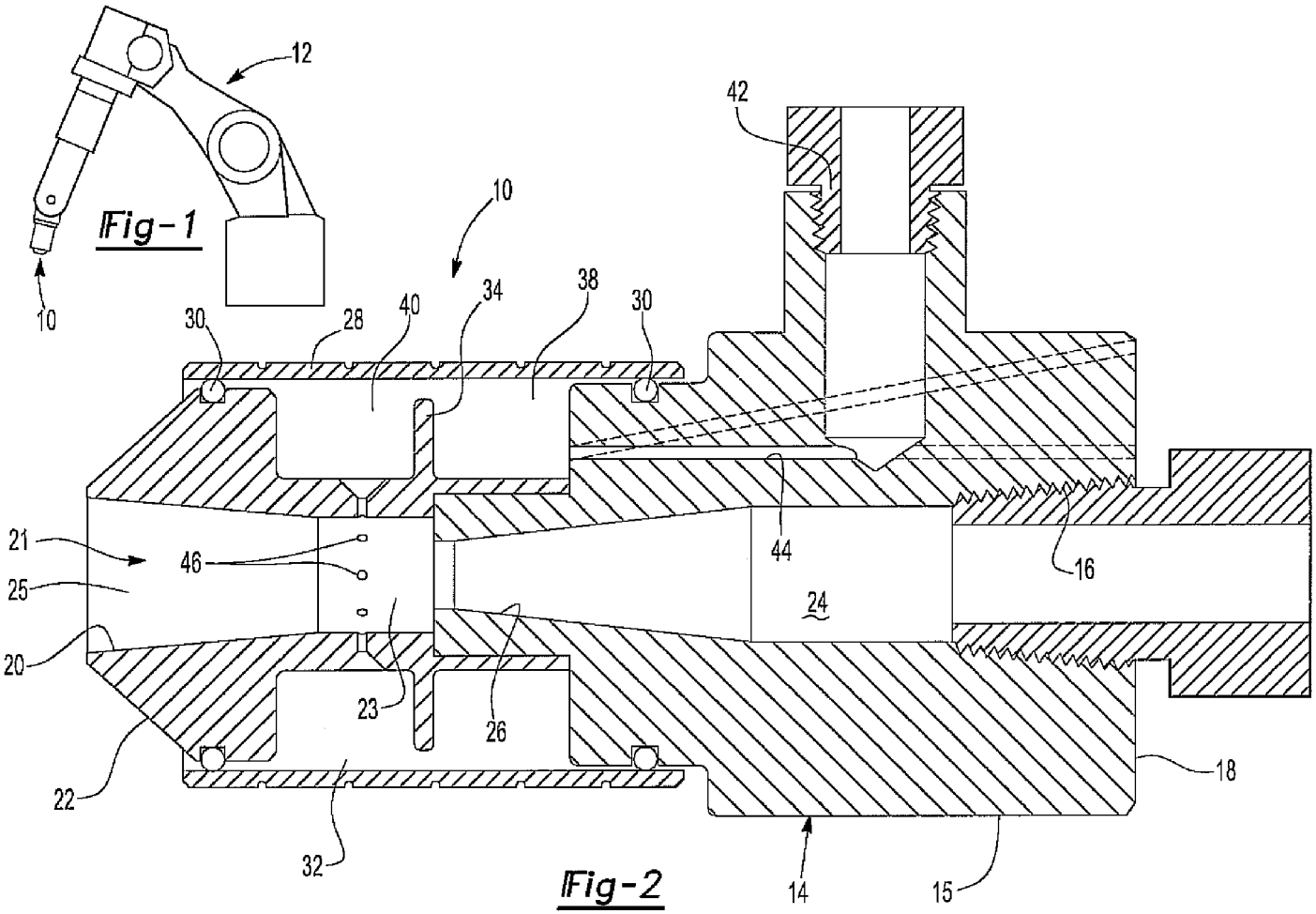
FIG. 1 is an elevational view illustrating a preferred embodiment of the present invention in use with a robotic arm.
FIG. 2 is a longitudinal sectional view illustrating a preferred embodiment of the present invention.

With reference first to FIG. 1, a high-pressure liquid projection assembly 10 according to the present invention for cleaning or deburring industrial parts is there shown connected to a free end of a robotic arm 12. In the conventional fashion, the robotic arm 12 manipulates the position of the assembly 10 in order to position the assembly 10 for the desired manufacturing and/or cleaning operation.

With reference now to FIG. 2, a portion of the liquid projection assembly 10 is illustrated and comprises a nozzle housing 14 having a body 15 and a sleeve 28 and which is elongated and generally circular in shape. An inlet 16 is formed at one end 18 of the housing 14 and an outlet 20 is formed at its other end 22. An elongated passageway 24 fluidly connects the inlet 16 to the outlet 20 and this passageway 24 includes a venturi section 26 which increases the liquid velocity at an intermediate position in the passageway between the inlet 16 and outlet 20 as well as an outlet cavity 21 adjacent the outlet 20. This outlet cavity 21 includes a cylindrical section 23 and an outwardly flared section 25 open to the outlet 20.

The sleeve 28 is disposed around the body 15 adjacent the end 22 of the housing 14. The sleeve 28 is fluidly sealed to the body 15 by annular O-rings 30 adjacent each end of the sleeve 28. The sleeve 28 and body 15, together, form a fluid chamber 32 which is generally annular in shape and disposed around the passageway 24 at an intermediate section of the passageway 24. The body 15 also includes an outwardly extending annular baffle 34 which protrudes into the chamber 32 and separates the chamber 32 into two subchambers 38 and 40. The purpose of the baffle 34 will be subsequently described.

Still referring to FIG. 2, a control port 42 is connected to and extends outwardly from the outer periphery of the body 15. This port 42 is fluidly connected to the subchamber 38 by a passage 44 formed in the body 15. Any conventional means may be used to form the passage 44, such as by drilling a longitudinally extending bore through the body 15 and plugging the outer end of that bore.

Figure 3:
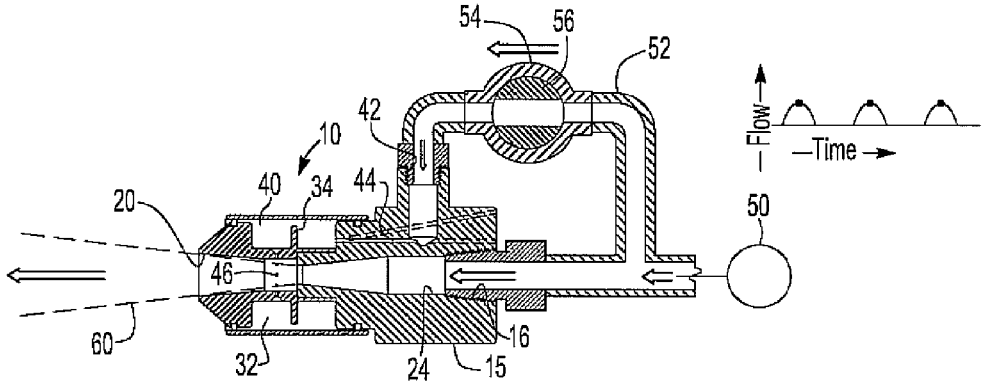
FIG. 3 is a longitudinal sectional view illustrating one mode or phase of operation of the present invention.

The subchamber 40 is fluidly connected to the cylindrical section 25 of the outlet cavity 21 by at least one and preferably a plurality of circumferentially spaced holes 46 formed through the body 15. These holes 46 are much smaller in cross-sectional shape than the outlet cavity section 25. With reference now to FIG. 3, a source 50 of high pressure liquid is fluidly connected to the housing inlet 16. The high pressure liquid source 50 typically has pressures in the range of several thousand psi.

A bypass passageway 52 fluidly connects the source 50 to the control port 42 through a valve 54 having a rotatable valve member 56. In the configuration illustrated in FIG. 3, the valve member 56 is oriented to permit free fluid flow through the bypass passageway 52 and into the control port 42.

In operation and with the valve member 56 in the position illustrated in FIG. 3, high pressure fluid flows through the passageway 24 from the inlet 16 and to the outlet 20. Simultaneously, high pressure fluid flows through the control port 42, through the passage 44 and into the housing chamber 32. From the housing chamber 32, the liquid flows through the ports 46 and into the main stream through the passageway 24.

The flow of liquid through the restricted ports 46 perturbs the fluid flow through the passageway 24 in the outlet cavity 21 thus resulting in a relatively wide liquid spray pattern 60. A wider spray pattern will in turn result in lower impact pressure applied on the industrial part to be treated; at the opposite, a narrow spray pattern will concentrate almost the same impact energy on smaller area, though resulting on a localized highest impact pressure. Such a wide spray pattern may be useful during a washing operation, for example, for washing industrial parts.

During the flow of the liquid through the control port 42 and into the chamber 32, the baffle 34 effectively minimizes fluid turbulence within the chamber 32 so that all turbulence in the fluid flow is effectively eliminated by the time the fluid reaches the subchamber 40 surrounding the openings 46. This, in turn, achieves relatively uniform flow through each of the holes 46 thus producing a uniform spray pattern 60.

Figure 4:
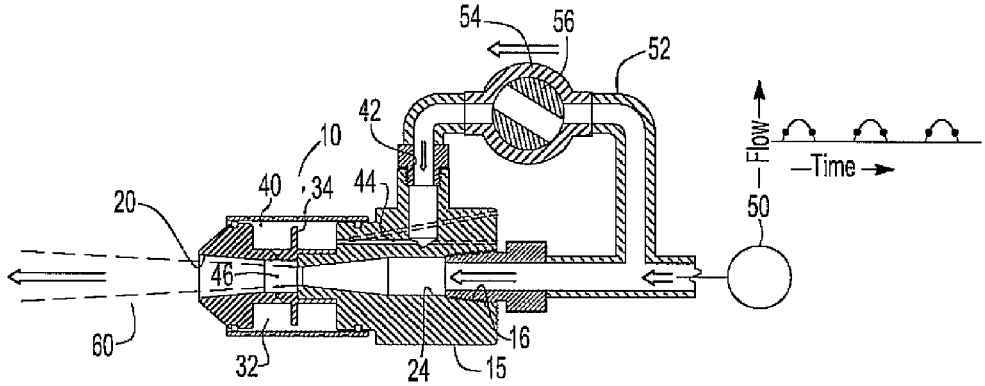
FIG. 4 is a view similar to FIG. 3, but illustrating a second mode or phase of operation.

With reference now to FIG. 4, the valve member 56 is rotated such that only a very restricted fluid flow is permitted through the valve 54 and into the control port 42. This, in turn, results in a lower fluid flow rate through the openings 46 so that the spray pattern 60' from the outlet 20 is narrower than the spray pattern 60 illustrated in FIG. 3.

Figure 5:
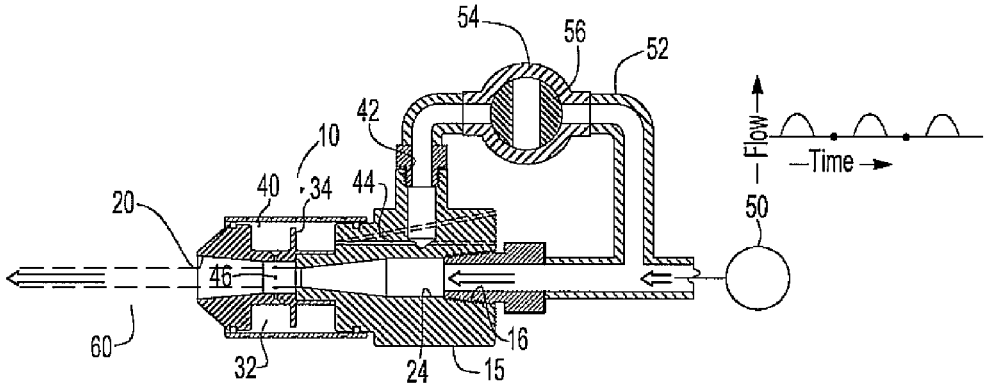
FIG. 5 is a view similar to FIGS. 3 and 4, but illustrating still a further mode or phase of operation of the present invention.

Similarly, with reference to FIG. 5, the valve member 56 is rotated so that all fluid flow into the control port 42 is terminated. When this occurs, no fluid flow occurs through the holes 46 thus producing a very narrow spray pattern 60" of the type that normally results from the venturi 26 alone.

Although the valve 54 is illustrated as having a rotary valve member 56, it will be understood, of course, that any type of valve may be utilized to control the fluid flow into the control port 42 without deviation from the spirit or scope of the present invention.

Furthermore, it will also be understood that the valve 54 may be selectively and variably opened and closed to a preset position thus resulting in the desired spray pattern 60-60". Conversely, however, the valve 54 may be continuously opened and closed, e.g. by a continuous rotation of the valve member 56, which produces a continually varying spray pattern from the relatively wide spray pattern 60 illustrated in FIG. 3 and to the narrow spray pattern 60" illustrated in FIG. 5. In many applications, such as washing applications, the actual washing operation can be accomplished more efficiently by continuously varying the spray pattern.

As can be seen from the foregoing, the present invention provides a novel liquid spray assembly in which the liquid projection pattern may be adjusted by merely adjusting the valve controlling the fluid flow into the control port. Consequently, the nozzle assembly 10, if manipulated by the robotic arm 12 illustrated in FIG. 1, may be adjusted for a relatively wide spray 60 by adjusting the valve member. Subsequently, by simply adjusting the valve member to the position shown in FIG. 5, a higher pressure spray may be used for other manufacturing operations, such as deburring operations, without physically changing the nozzle housing 14.

Having described my invention, however, many modifications thereto will become apparent to those skilled in the art to which it pertains without deviation from the spirit of the invention as defined by the scope of the appended claims.

I claim:

1. A high-pressure liquid projection assembly for cleaning or deburring industrial parts comprising:

a nozzle housing having an inlet adapted for connection with a pressurized liquid source, an outlet and a fluid passageway connecting said inlet to said outlet, said passageway forming an outlet cavity adjacent the outlet, a fluid chamber formed in said housing, said fluid chamber being disposed around an intermediate portion of said outlet cavity, at least one opening formed in said housing which fluidly connects said fluid chamber to said passageway, a control port on said housing and a passage in said housing which fluidly connects said control port to said fluid chamber, wherein said control port is adapted to be connected to the pressurized liquid source having a variable flow to thereby vary the spray pattern from said outlet.

2. The high-pressure liquid projection assembly as defined in claim 1 and comprising a variable opening valve connected between the pressurized liquid source and said control port for providing the variable flow.

3. The high-pressure liquid projection assembly as defined in claim 2 and comprising means for cyclically opening and closing said valve to thereby modulate the spray pattern from said outlet.

4. The high-pressure liquid projection assembly as defined in claim 1 and comprising a baffle disposed in said fluid chamber which defines two subchambers in said fluid chamber.

5. The high-pressure liquid projection assembly as defined in claim 4 wherein said passage is open to one subchamber and said opening is open to the other subchamber.

6. The high-pressure liquid projection assembly as defined in claim 1 wherein said at least one opening comprises a plurality of circumferentially spaced openings.

7. The high-pressure liquid projection assembly as defined in claim 1 and comprising a venturi formed at an intermediate position along said passageway.

8. The high-pressure liquid projection assembly as defined in claim 7 wherein said at least one opening is open to said passageway at a position between said venturi and said outlet.

9. The high-pressure liquid projection assembly as defined in claim 1 wherein said housing comprises a body through which said passageway is formed and a sleeve disposed around said body, said fluid chamber being formed between said body and said sleeve.

10. The high-pressure liquid projection assembly as defined in claim 1 wherein said nozzle housing is adapted to be carried by a robotic arm.

* * * * *